US005328146A

United States Patent [19]

Lin

[11] Patent Number: 5,328,146

[45] Date of Patent: Jul. 12, 1994

[54] CLAMPING DEVICE FOR MOLD BOARDS

[76] Inventor: Tai-Yuan Lin, No. 15, Lane 191, Sec. 1, Tung Shan Rd., Taichung, Taiwan

[21] Appl. No.: 12,429

[22] Filed: Feb. 2, 1993

[51] Int. Cl.[5] ..... E04G 17/00

[52] U.S. Cl. ..... 249/219.1; 249/40; 249/46; 249/210; 249/213; 249/216; 24/442; 24/634; 74/606 R; 277/212 C; 277/212 R

[58] Field of Search ..... 249/40, 46, 210, 213, 249/216, 219.1; 24/634, 442; 74/606 R; 277/212 C, 212 R, 212 FB, 237 A, DIG. 4

[56] References Cited

U.S. PATENT DOCUMENTS

| | | | |
|---|---|---|---|
| 1,347,196 | 7/1920 | Werner | 249/219.1 |
| 3,038,347 | 6/1962 | Sloan et al. | 277/212 X |
| 3,057,034 | 10/1962 | Helmick | 249/213 |
| 3,525,495 | 8/1970 | Brosseau | 249/219.1 |
| 4,329,857 | 5/1982 | Kittle et al. | 220/229 |
| 4,587,695 | 5/1986 | Jensen | 24/634 |
| 4,746,127 | 5/1988 | Westhoff et al. | 277/1 |
| 4,785,906 | 11/1988 | Kang | 180/270 |
| 4,895,550 | 1/1990 | Baker | 464/175 |

*Primary Examiner*—James C. Housel
*Assistant Examiner*—Harold Pyon
*Attorney, Agent, or Firm*—Morton J. Rosenberg; David I. Klein

[57] ABSTRACT

A clamping device for clamping mold boards together includes a base, a bracket extended upward from the base, a space and a chamber formed in the bracket, a lever pivotally coupled between the wall members and having a number of teeth formed on the lower end. A cover is engaged on the bracket for covering the bracket and includes a slit formed in the upper surface for engagement with the lever.

2 Claims, 2 Drawing Sheets

CLAMPING DEVICE FOR MOLD BOARDS

BACKGROUND OF THE INVENTION

1. Field of the Invention

The present invention relates to a clamping device, and more particularly to a clamping device for clamping mold boards together.

2. Description of the Prior Art

A typical clamping device for mold boards is disclosed in FIG. 4 and comprises a base 11 having a hole 111 formed in the middle portion and having a bracket 12 extended upward therefrom, the bracket 12 includes a space 13 formed between a pair of wall members 15, and a chamber 14 communicated with the space 13 and connected with the hole 111, a bolt for coupling mold boards may extend into the chamber 14 via the hole 111 and to be fixed in place, a lever 16 includes a lower end pivotally coupled between the wall members 15 and a plurality of teeth 17 located in the chamber 14 for engaging with the bolt so as to lock the bolt in place, and a spring 18 for biasing the lever 16, whereby, the mold boards can be solidly fixed together. However, the upper portion of the wall members 15 is exposed such that water or dust, particularly the mud, slurry or concrete such that the parts of the clamping device are apt to be rusted, and such that the working life of the clamping device is short.

The present invention has arisen to mitigate and/or obviate the afore-described disadvantages of the conventional clamping devices for mold boards.

SUMMARY OF THE INVENTION

The primary objective of the present invention is to provide a clamping device for mold boards in which the clamping device is protectively covered such that the working life of the clamping device is increased.

In accordance with one aspect of the invention, there is provided a clamping device for clamping mold boards together comprising a base including a hole formed in a middle portion thereof, a bracket extended upward therefrom and including a pair of wall members having a space formed therebetween, a chamber communicated with the space and aligned with the hole of the base, a lever having a lower end pivotally coupled between the wall members and an upper end engageable with the bracket, means for biasing the upper end of the bracket to engage with the bracket, the lever including a plurality of teeth formed on the lower end and located within the chamber, and a cover engaged on the bracket and including an upper surface having an opening formed therein for engaging with the upper end of the lever, a slit formed along a longitudinal direction of the upper surface and connected with the opening, whereby, the upper end of the lever is engageable in the slit of the cover.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
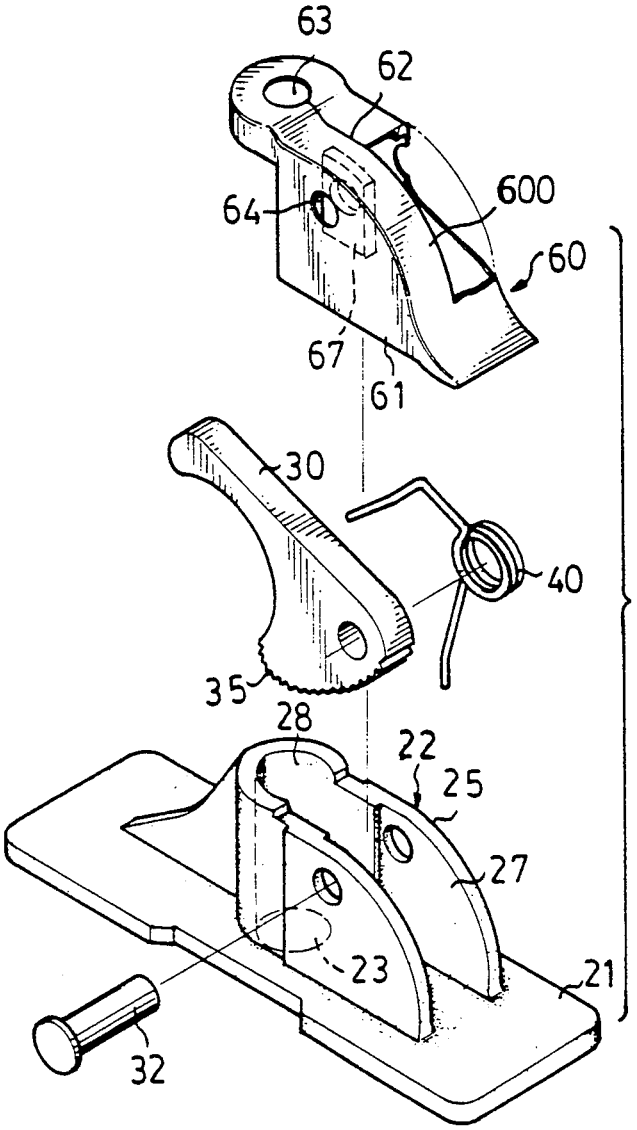
FIG. 1 is an exploded view of a clamping device in accordance with the present invention.
Figure 2:
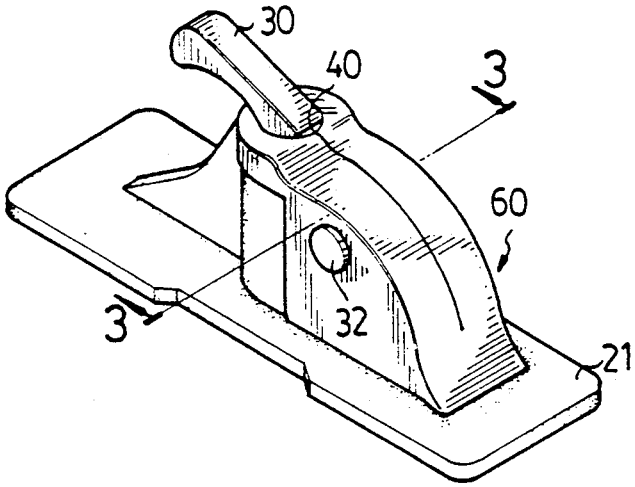
FIG. 2 is a perspective view of the clamping device.
Figure 3:
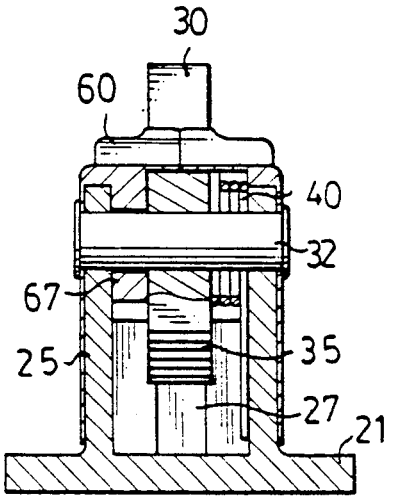
FIG. 3 is a cross sectional view taken along lines 3—3 of FIG. 2.
Figure 4:
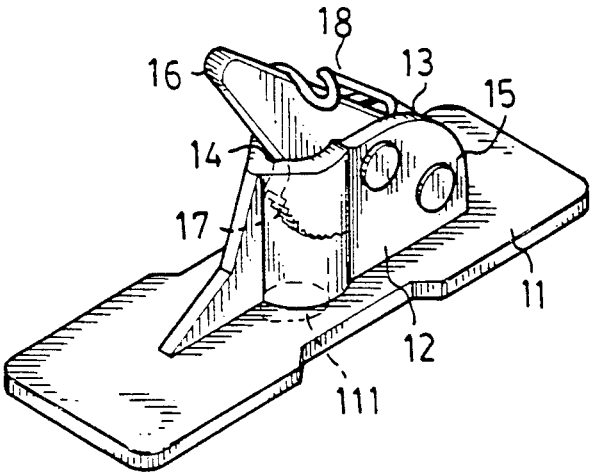
FIG. 4 PRIOR ART
FIG. 4 is a perspective view illustrating the typical clamping device for mold boards.

Referring to FIGS. 1 to 3, a clamping device in accordance with the present invention comprises a base 21 having a hole 23 formed in the middle portion and having a bracket 22 extended upward therefrom, the bracket 22 includes a space 27 formed between a pair of wall members 25, and a chamber 28 communicated with the space 27, a bolt for coupling mold boards (not shown) may extend upward into the chamber 28 via the hole 23 of the base 21 and to be fixed in place, a lever 30 includes a lower end pivotally coupled between the wall members 25 by a pin 32 and a plurality of teeth 35 formed integral thereon and located in the chamber 28 for engaging with the bolt so as to lock the bolt in place, and a spring 40 engaged on the pin 32 for biasing the upper portion of the lever downward against the bracket 22, whereby, the mold boards can be solidly fixed together. The base 21, the bracket 22 and the lever 30 are well known in the art and will not be described in further details.

The clamping device in accordance with the present invention further includes a cover 60 for covering the bracket 22 in order to prevent the dust or water from entering into the space 27 of the bracket 22, the cover 60 is preferably made of rubber materials and includes an upper surface 600 for covering the bracket 22, a panel 61 dependent thereon for contacting one of the wall members 25 of the bracket 22, a slit 62 formed along the longitudinal direction of the upper surface 600, an opening 63 formed in the end portion of the upper surface 600 for receiving the lever 30, best shown in FIG. 2, an aperture 64 formed in the panel 61 and engaged with the pin 32, and a lug 67 extended downward therefrom and located in said space 27 of said bracket 22 and engaged with the pin 32 such that the cover 60 can be fixed in place.

In operation, the lever 30 may be rotated about the pin 32 and may be engaged in the slit 62 due to the resilient characteristics of the rubber materials of the cover 60, the cover 60 suitably covers the bracket of the clamping device such that any object can be prevented from entering into the clamping device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A clamping device for clamping mold boards together comprising a base including a hole formed in a middle portion thereof, a bracket extended upward therefrom and including a pair of wall members having a space formed therebetween, a chamber communicated with said space and aligned with said hole of said base, a lever having a lower end pivotally coupled between said wall members and an upper end engageable with said bracket, means for biasing said upper end of said bracket to engage with said bracket, said lever including a plurality of teeth formed on said lower end and located within said chamber, and a cover engaged on said bracket for enclosing said bracket and including an upper surface having an opening formed therein on one end of said cover for extending therethrough of said upper end of said lever, said cover having a slit formed along a longitudinal direction of said upper surface and in communication with said opening, whereby, said upper end of said lever is engageable in said slit of said cover, said lower end of said lever is pivotally supported between said wall members by a pin, said cover including a panel extended downwardly therefrom for contacting said bracket wall members, said panel having an aperture formed therethrough for insert of said pin for retaining said cover in place.

2. A clamping device according to claim 1, wherein said cover includes a lug extended downward therefrom and located in said space of said bracket and engaged with said pin, whereby, said cover is further retained in place.

* * * * *